US009644842B2

(12) United States Patent
Harada

(10) Patent No.: US 9,644,842 B2
(45) Date of Patent: May 9, 2017

(54) GLOW PLUG AND MANUFACTURING METHOD THEREOF

(71) Applicant: NGK SPARK PLUG CO., LTD., Nagoya-shi, Aichi-ken (JP)

(72) Inventor: Sadamitsu Harada, Nagoya (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 324 days.

(21) Appl. No.: 13/888,985

(22) Filed: May 7, 2013

(65) Prior Publication Data

US 2013/0312691 A1 Nov. 28, 2013

(30) Foreign Application Priority Data

May 7, 2012 (JP) ..... 2012-106149

(51) Int. Cl.
*F23Q 7/00* (2006.01)
*F02P 19/00* (2006.01)

(52) U.S. Cl.
CPC ..... *F23Q 7/001* (2013.01); *F02P 19/00* (2013.01); *Y10T 29/49083* (2015.01)

(58) Field of Classification Search
CPC ..... F23Q 7/001; F23Q 2007/004; F23Q 7/00; Y10T 29/49083; F02P 19/00; F02P 19/02
See application file for complete search history.

(56) References Cited

U.S. PATENT DOCUMENTS 5,589,091 A * 12/1996 Muller ..... F23Q 7/001 123/145 A
2003/0029855 A1 2/2003 Haluschka et al.
2004/0084436 A1 5/2004 Reissner et al.
(Continued)

FOREIGN PATENT DOCUMENTS

EP 0798515 A2 10/1997
IT EP 0798515 A2 * 10/1997 ..... F23Q 7/001
JP 53-141840 A 12/1978
(Continued)

OTHER PUBLICATIONS

Communication dated Mar. 17, 2015, issued by the Korean Intellectual Property Office in counterpart Korean application No. 10-2013-0051432.
(Continued)

*Primary Examiner* — Jacob Amick
(74) *Attorney, Agent, or Firm* — Sughrue Mion, PLLC

(57) ABSTRACT

A glow plug (1) provided with heater (2); tubular main metal shell (4) with shaft hole (43); conductive member (3) extending in the shaft hole toward a rear end side GK; metal terminal member (5) with one part (55) positioned in the shaft hole and another part (56) protruding from a rear end (48) of the main metal shell toward the rear end side GK, the terminal member including an enclosing portion (51) opened toward a front end side GS housing a rear end portion (32) of the conductive member and having electrical continuity with the rear end portion, the terminal member being disposed in the shaft hole while spaced apart from an inner peripheral surface 43*m* of the main metal shell; and sealing member (7) made of an insulator and airtightly sealing and insulating between the inner peripheral surface and the terminal member in the shaft hole.

8 Claims, 5 Drawing Sheets

(56) References Cited

U.S. PATENT DOCUMENTS

2007/0241092 A1* 10/2007 Suzuki ..... 219/260

FOREIGN PATENT DOCUMENTS

| | | | |
|---|---|---|---|
| JP | 2004-502090 | A | 1/2004 |
| JP | 2005-507068 | A | 3/2005 |
| JP | 2006-112478 | A | 4/2006 |
| JP | 2007-292444 | A | 11/2007 |
| JP | 2010-096459 | A | 4/2010 |
| JP | 2011-075148 | A | 4/2011 |

OTHER PUBLICATIONS

Communication dated Dec. 8, 2015, issued by the Japan Patent Office in corresponding Japanese Application No. 2012-106149.

* cited by examiner

GLOW PLUG AND MANUFACTURING METHOD THEREOF

TECHNICAL FIELD

The present invention relates to a glow plug used for assisting the starting of a diesel engine, and a method for manufacturing the same.

BACKGROUND ART

A glow plug used for assisting the starting of a diesel engine includes a heater that generates heat by conduction and that is retained on the front end side of a main metal shell. The glow plug is used with the front end portion of the heater jutting into the engine. The main metal shell has a shaft hole into which a metal conductive member (such as a bar-like center wire) having electrical continuity with a heater terminal and extending toward the rear end side in the axial direction is inserted. The rear end portion of the center wire protrudes from the rear end surface of the main metal shell. Further, the rear end portion of the center wire is fixedly enclosed by a metal terminal member by crimping or threaded engagement for connection with an external device, thus establishing electrical continuity between the center wire and the terminal member.

In the glow plug of such a configuration, the gap between the rear end portion of the main metal shell and the center wire is sealed with an O-ring in the shaft hole so as to ensure airtightness between the inside of the glow plug (main metal shell) and the outside on the rear end side. Further, an insulating member for ensuring insulation between the main metal shell and the center wire is disposed on the rear end side of the O-ring between the rear end portion of the main metal shell and the center wire (e.g., Patent Document 1).

PRIOR ART DOCUMENT

Patent Document

[Patent Document 1] JP-A-2007-292444

SUMMARY OF THE INVENTION

Problem to be Solved by the Invention

Thus, in the conventional glow plug, airtightness between the inside of the glow plug (main metal shell) and the outside on the rear end side is maintained by the O-ring disposed between the main metal shell and the center wire in the shaft hole of the main metal shell. The terminal member fixed onto the rear end portion of the center wire presses the insulating member disposed on the rear end side of the O-ring, and the insulating member presses the O-ring toward the front end side.

While in such a glow plug the airtightness within the glow plug can be maintained by the O-ring, the connecting surfaces of the center wire and the terminal member (such as crimp-joined surfaces of the center wire and the terminal member, or an external thread surface of the center wire and an internal thread surface of the terminal member) on the rear end side of the O-ring are not sealed and are therefore accessible by external air.

The external air around the glow plug may contain moisture or corrosive gas. Thus, the rear end portion of the center wire and the inner surface of the terminal member enclosing the center wire, including the connecting surfaces of the center wire and the terminal member, may be corroded by contact with the moisture or corrosive gas, resulting in an increase in resistance between the connecting surfaces.

Particularly, some of glow plugs of rapid heating type that have been used in recent years have low normal temperature resistance values of the heater on the order of several hundred mΩ. When the resistance value between the connecting surfaces is increased, the temperature rise of the glow plug may be delayed, or the saturation temperature may be decreased. As a result, desired characteristics may not be obtained, and the starting ability of the diesel engine may be lowered.

The present invention was made in view of the above circumstances, and an object of the present invention is to provide a glow plug that suppresses corrosion of the connecting surfaces of a conductive member and a terminal member, and a method for manufacturing the same.

Means for Solving the Problems

According to an embodiment, a glow plug includes a heater that generates heat by energization; a main metal shell having a tubular shape with a shaft hole and retaining the heater directly or indirectly on a front end side in an axial direction extending along its own axis; a metal conductive member having electrical continuity with one terminal of the heater and extending in the shaft hole toward a rear end side in the axial direction; a metal terminal member with one part positioned in the shaft hole and another part protruding from a rear end of the main metal shell toward the rear end side in the axial direction, the terminal member including an enclosing portion opened toward the front end side in the axial direction, the enclosing portion housing a rear end portion of the conductive member and having electrical continuity with the rear end portion, the terminal member being disposed in the shaft hole while spaced apart from an inner peripheral surface of the main metal shell forming the shaft hole; and a sealing member made of an insulator and airtightly sealing and insulating between the inner peripheral surface and the terminal member in the shaft hole.

In this glow plug, the rear end portion of the conductive member is housed in the enclosing portion of the terminal member, and the inner peripheral surface of the main metal shell and the terminal member is airtightly sealed by the sealing member in the shaft hole of the main metal shell, thereby sealing the shaft hole. Thus, the rear end portion of the conductive member, including a connecting surface of the conductive member for crimping or threaded engagement, and the inner surface of the enclosing portion of the terminal member, including a connecting surface of the terminal member, do not come into contact with the external air on the rear end side of the glow plug, and therefore do not contact moisture or corrosive gas. Accordingly, in the glow plug, corrosion of the connecting surfaces of the conductive member and the terminal member can be suppressed.

As the sealing member, a tubular member or a ring-shaped member made of a rubber-like elastic material may be mentioned. Among others, an O-ring made of a ring-shaped rubber-like elastic material may be suitably used. Generally, many of O-rings have a substantially circular cross sectional shape in a free state. However, the shape of the O-ring is not limited to such a shape. For example, the O-ring may have an elliptical or oval cross sectional shape, or D-shaped cross sectional shape with a tubular (cylindrical) inner peripheral surface contacting the terminal member and an outer peripheral surface bulging outward in a radial direction. As the material of the sealing member, rubber-like elastic materials such as fluorine-based rubber, silicone rubber, chloroprene rubber, and SBR may be mentioned.

The conductive member may be entirely positioned in the shaft hole of the main metal shell, or one part may protrude from the rear end surface of the main metal shell. In the former case, the enclosing portion of the terminal member is entirely or mostly positioned in the shaft hole of the main metal shell. In the latter case, a part of the enclosing portion is positioned in the shaft hole.

Preferably, in order to reliably insulate between the main metal shell and the terminal and conductive members, a separate insulating spacer may be provided between the inner peripheral surface of the main metal shell and the terminal member in addition to the sealing member, with the conductive member and the terminal member retained within the shaft hole of the main metal shell.

The glow plug may further include an insulating spacer made of an insulator and positioned on the rear end side of the sealing member in the axial direction between the inner peripheral surface and the terminal member.

This glow plug is provided with the insulating spacer disposed between the inner peripheral surface of the main metal shell and the terminal member on the rear end side of the sealing member. Thus, the conductive member and the terminal member can be reliably spaced apart from the main metal shell, whereby the main metal shell and the terminal member can be reliably insulated from each other. Further, the external air (moisture or corrosive gas) can be suppressed from circulating to the sealing member.

In the glow plug, the terminal member may include a spacer engaging portion and may be engaged with the insulating spacer at the spacer engaging portion, and the insulating spacer may be biased toward the front end side in the axial direction.

In this glow plug, the insulating spacer is biased toward the front end side in the axial direction, so that the falling or loosening of the sealing member can be prevented via the insulating spacer.

In the glow plug, the sealing member may be made of an insulating rubber-like elastic material. The sealing member, in a free state, may have a ring shape encircling its own member axis and include a member outer peripheral surface having a shape bulging outward in a radial direction of the member axis with a radius of curvature R1 in a member axial direction along the member axis, and a member inner peripheral surface having a shape bulging inward in the radial direction with a radius of curvature R2 in the member axial direction which is greater than the radius of curvature R1, or a having tubular shape with the same cross sectional shape with respect to the member axial direction. The sealing member may have a dimension in the member axial direction which is greater than a thickness dimension in the radial direction. The sealing member may be pressed onto the inner peripheral surface of the main metal shell via the member outer peripheral surface and onto the terminal member via the member inner peripheral surface.

In this glow plug, the sealing member is a rubber-like elastic material and, in a free state, has the above shape, i.e., an outwardly bulging, substantially D-shaped cross sectional shape. Thus, when the sealing member is press-fitted between the inner peripheral surface of the main metal shell and the terminal member, the member inner peripheral surface of the sealing member closely attaches onto the terminal member via a tubular surface with a long axial dimension. On the other hand, the member outer peripheral surface contacts the inner peripheral surface of the main metal shell via a tubular surface with a relatively short axial dimension, with the radially outward bulge compressed. Thus, the sealing member can be inserted into the shaft hole while suppressing the development of rotation or localized torsion in the sealing member as it is press-fitted. Accordingly, searing stress due to torsional strain does not easily remain in the sealing member, and troubles such as tearing of the sealing member can be suppressed, thus increasing the sealing reliability of the glow plug due to the sealing member.

In another embodiment, there is provided a method for manufacturing a glow plug including a heater that generates heat by energization; a main metal shell having a tubular shape with a shaft hole and retaining the heater directly or indirectly on a front end side in an axial direction extending along its own axis; a metal conductive member electrically connected to one terminal of the heater and extending in the shaft hole toward a rear end side in the axial direction; a metal terminal member with one part positioned in the shaft hole and another part protruding from a rear end of the main metal shell toward the rear end side in the axial direction, the terminal member including an enclosing portion opened toward the front end side in the axial direction, the enclosing portion housing a rear end portion of the conductive member and having electrical continuity with the rear end portion, the terminal member being disposed in the shaft hole while spaced apart from an inner peripheral surface of the main metal shell forming the shaft hole; and a sealing member made of an insulator and airtightly sealing and insulating between the inner peripheral surface and the terminal member in the shaft hole. The method includes an externally fitting step of externally fitting the sealing member onto a portion that forms the one part of the terminal member; and an inserting step of inserting the portion forming the one part of the terminal member, the portion having the sealing member externally fitted onto the portion into the shaft hole from the rear end side of the main metal shell in the axial direction.

In this method for manufacturing a glow plug, the sealing member is externally fitted onto the terminal member in the externally fitting step, and then the terminal member with the externally fitted sealing member is inserted into the shaft hole of the main metal shell from the rear end side thereof in the axial direction in the inserting step. Thus, the sealing member can be easily disposed between the inner peripheral surface of the main metal shell and the terminal member. Further, in this way, the connecting surfaces of the conductive member and the terminal member can be prevented from coming into contact with moisture or corrosive gas contained in the external air, so that a glow plug such that corrosion of the connecting surfaces is suppressed can be obtained.

The method for manufacturing a glow plug may include an insulating spacer made of an insulator and positioned on the rear end side of the sealing member in the axial direction between the inner peripheral surface and the terminal member. The externally fitting step may include externally fitting the insulating spacer onto the portion forming the one part of the terminal member such that the insulating spacer is positioned on the rear end side of the sealing member in the axial direction. The inserting step may include inserting the portion forming the one part of the terminal member, the portion having the sealing member and the insulating spacer externally fitted onto the portion into the shaft hole from the rear end side of the main metal shell in the axial direction.

In this method for manufacturing a glow plug, the insulating spacer is externally fitted on the rear end side of the sealing member in the axial direction in the externally fitting step, and the terminal member as well as the sealing member and the insulating spacer is inserted into the shaft hole of the main metal shell from the rear end side in the axial direction in the inserting step. Thus, the sealing member and the insulating spacer can be easily disposed.

In the method for manufacturing a glow plug, the sealing member may be made of an insulating rubber-like elastic material. The sealing member may have, in a free state, a ring shape encircling its own member axis and include a member outer peripheral surface having a shape bulging outward in a radial direction of the member axis with a radius of curvature R1 in a member axial direction along the member axis, and a member inner peripheral surface having a shape bulging inward in the radial direction with a radius of curvature R2 in the member axial direction which is greater than the radius of curvature R1, or having a tubular shape with the same cross sectional shape with respect to the member axial direction. The sealing member may have a dimension in the member axial direction which is greater than a thickness dimension in the radial direction. The sealing member may be pressed onto the inner peripheral surface of the main metal shell via the member outer peripheral surface and onto the terminal member via the member inner peripheral surface. The external fitting step may include externally fitting the sealing member onto the portion forming the one part in a tightened manner. The inserting step may include inserting the portion forming the one part of the terminal member into the shaft hole from the rear end of the main metal shell while causing the member outer peripheral surface of the sealing member to be pressed onto the inner peripheral surface of the main metal shell.

In this method for manufacturing a glow plug, the sealing member is a rubber-like elastic material and has, in a free state, an outwardly bulging, substantially D-shaped cross sectional shape. In the externally fitting step, the sealing member is externally fitted onto the terminal member in a tightened manner. Namely, the sealing member is externally fitted onto the "portion forming the one part" of the terminal member that has a greater outer diameter than an inner diameter of the sealing member in a free state. In the inserting step, the portion forming the one part of the terminal member is inserted into the shaft hole of the main metal shell from the rear end thereof, while the member outer peripheral surface of the sealing member is pressed onto the inner peripheral surface of the main metal shell. Thus, the sealing member can be disposed between the inner peripheral surface of the main metal shell and the terminal member while suppressing the development of rotation or localized torsion in the sealing member in the inserting step.

MODE FOR CARRYING OUT THE INVENTION

Figure 1:
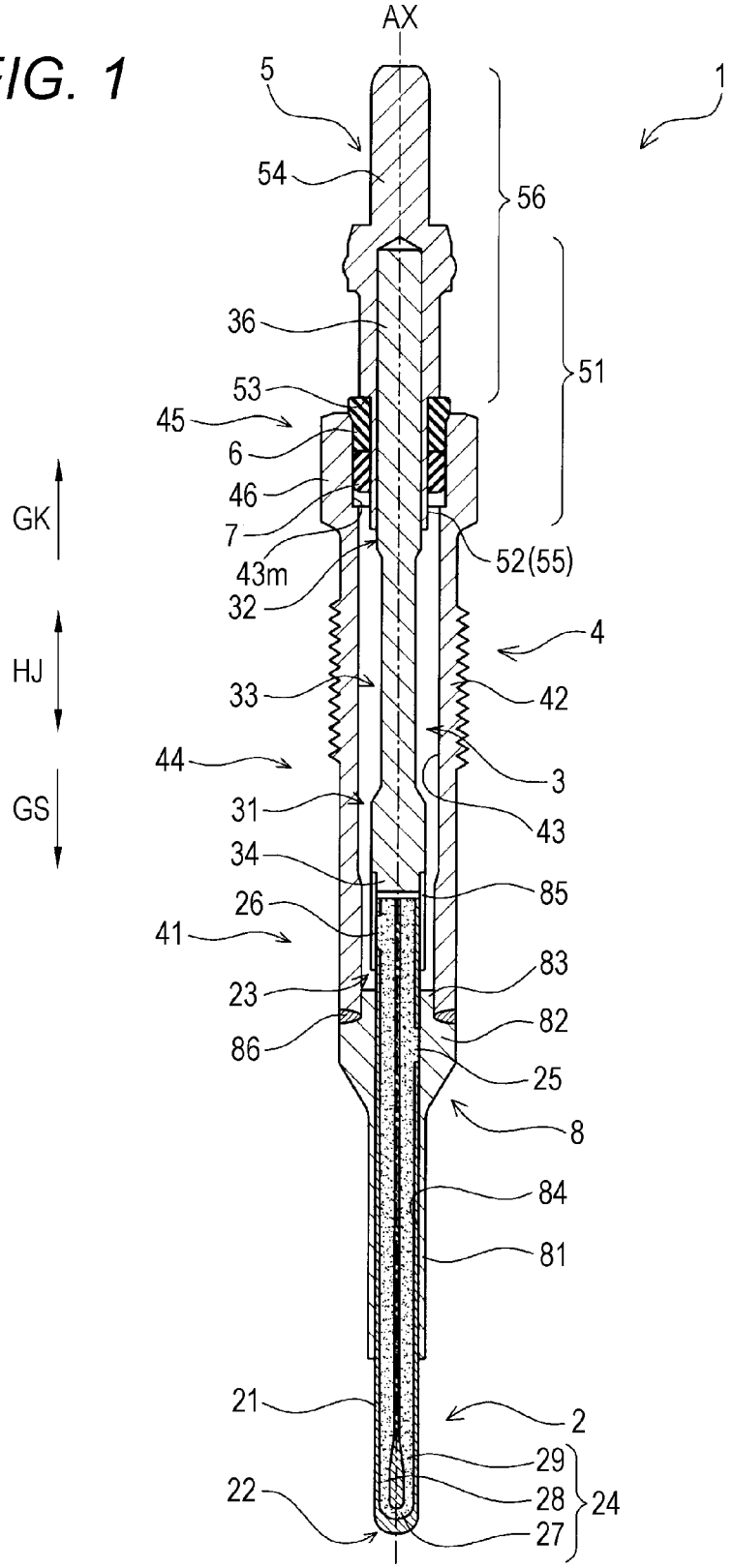
FIG. 1 is a longitudinal cross-sectional view of a glow plug according to an embodiment.
Figure 2:
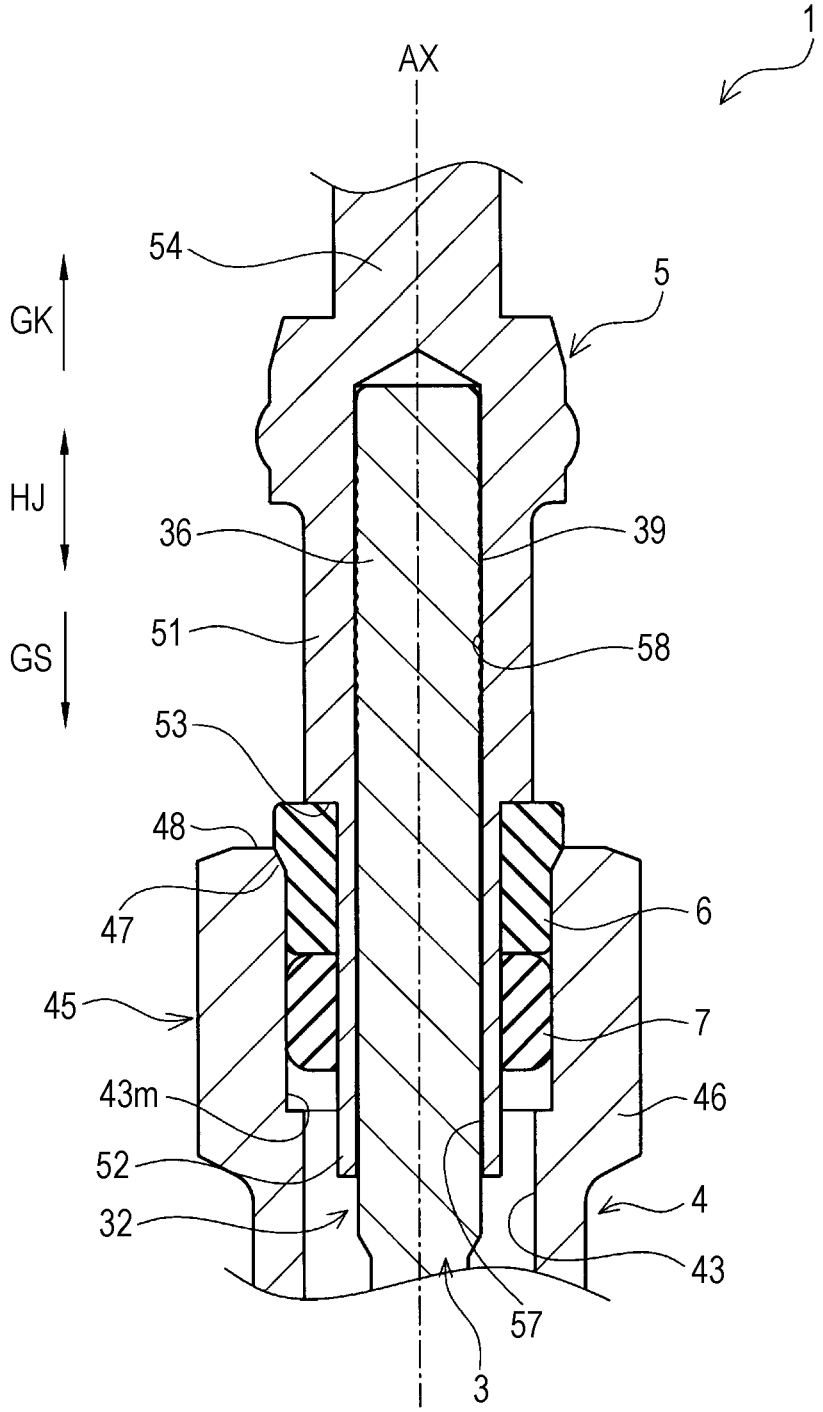
FIG. 2 is an enlarged longitudinal cross-sectional view of a portion of the glow plug on the rear end side according to the embodiment.

In the following, an embodiment of the present invention will be described with reference to the drawings. First, the overall structure of a glow plug 1 according to the present embodiment will be described with reference to FIGS. 1 and 2. FIG. 1 is a longitudinal cross-sectional view of the glow plug 1 as a whole. In FIG. 1, the side in an axial direction HJ along an axis AX of the glow plug 1 on which a ceramic heater 2 is disposed (bottom of the figure) will be referred to as a front end side GS of the glow plug 1, and the opposite side (top of the figure) will be referred to as a rear end side GK of the glow plug 1. FIG. 2 is an enlarged longitudinal cross-sectional view of a part of the glow plug 1 in the vicinity of the rear end thereof.

The glow plug 1 shown in FIG. 1 is attached to a fuel chamber (not shown) of a diesel engine, for example, and utilized as a heat source for assisting ignition at the start of the engine. The glow plug 1 is provided with a ceramic heater 2, a shell 8, a connecting ring 85, a main metal shell 4, a center wire 3, a terminal member 5, an insulating spacer 6, and an O-ring 7.

The ceramic heater 2 will be described. The ceramic heater 2 has a round-bar shape with a front end portion 22 curved in hemispherical shape. The ceramic heater 2 has a structure such that a heating resistor 24 made of conductive ceramic (specifically, silicon nitride ceramic containing tungsten carbide as a conductive component) is embedded in an insulating base member 21 made of insulating ceramic (specifically, silicon nitride ceramic). The heating resistor 24 includes a heating portion 27 disposed in the front end portion 22 of the ceramic heater 2 and having a U-like bent shape, and a pair of lead portions 28 and 29 connected to both ends of the heating portion 27 and extending in parallel toward a rear end portion 23 of the ceramic heater 2. The heating portion 27 is formed such that its cross sectional area is small compared with the lead portions 28 and 29. When energized, mainly the heating portion 27 of the heating resistor 24 generates heat. The lead portions 28 and 29 are respectively formed with electrode drawing-out portions 25 and 26 which protrude from the rear end side of the ceramic heater 2 in respectively radial directions of the ceramic heater 2 and are exposed on the outer peripheral surface. The electrode drawing-out portions 25 and 26 are formed at positions displaced from each other along the axial direction HJ. The electrode drawing-out portion 26 is positioned at the rear end portion 23 of the ceramic heater 2, whereas the electrode drawing-out portion 25 is positioned more toward the front end side GS.

Next, the shell 8 will be described. The shell 8 is a tubular metal member with a tubular hole 84 penetrating in the axial direction HJ. The shell 8 includes, from its own front end side GS toward the rear end side GK, a cylindrical body portion 81, a flange portion 82 with a greater diameter than the body portion 81, and a stepped main metal shell fitting portion 83 that fits in a front end portion 41 of the main metal shell 4, as will be described later. The shell 8 has the ceramic heater 2 inserted in the tubular hole 84 and retained radially from the outside, with the front end portion 22 and the rear end portion 23 of the ceramic heater 2 exposed. Of the electrode drawing-out portions 25 and 26 of the ceramic heater 2, the electrode drawing-out portion 25 on the front end side GS is connected to and has electrical continuity with the shell 8 within the tubular hole 84. Thus, as will be described later, by laser-welding the front end portion 41 of the main metal shell 4 and the main metal shell fitting portion 83 of the shell 8, the electrode drawing-out portion 25 establishes electrical continuity also with the main metal shell 4.

On the rear end portion 23 of the ceramic heater 2 that is exposed more toward the rear end side GK than the main metal shell fitting portion 83 of the shell 8, a metal and tubular connecting ring 85 is externally fitted by press-fitting. The electrode drawing-out portion 26 of the ceramic heater 2 is in contact with an inner peripheral surface of the connecting ring 85, so that the electrode drawing-out portion 26 and the connecting ring 85 have electrical continuity with each other. On the other hand, the connecting ring 85 is disposed in and spaced apart from the main metal shell 4, so that the connecting ring 85 is insulated from the main metal shell 4.

Next, the main metal shell 4 will be described. The main metal shell 4 is a tubular metal member with a shaft hole 43 penetrating in the axial direction HJ. The front end portion 41 of the main metal shell 4 is externally fitted onto to the main metal shell fitting portion 83 of the shell 8, with their engaged portions joined by laser beam welding at a welded portion 86, whereby the front end portion 41 has electrical continuity with the electrode drawing-out portion 25 of the ceramic heater 2 via the shell 8. An outer peripheral surface on the rear end side GK of a middle body portion 44 between the front end portion 41 and the rear end portion 45 is provided with an installation portion 42 formed with threads for installing the glow plug 1 to the engine head (not shown) of an internal combustion engine. Further, the outer periphery of the rear end portion 45, which is further toward the rear end side GK than the installation portion 42, is formed with a tool engaging portion 46 with hexagonal cross sectional shape to be engaged with a tool when installing the glow plug 1 to the engine head. As shown in FIG. 2, an opening portion of the shaft hole 43 in the rear end portion 45 of the main metal shell 4 is provided with a tapered portion 47 expanding toward a rear end surface 48.

Next, the center wire 3 will be described. As shown in FIG. 1, the center wire 3 is a bar-like metal member extending in the axial direction HJ. Although the center wire 3 is inserted within the shaft hole 43 of the main metal shell 4, the center wire 3 is maintained in an insulated state from the main metal shell 4. A middle body portion 33 between a front end portion 31 and a rear end portion 32 of the center wire 3 has a reduced diameter compared with the front end portion 31 and the rear end portion 32. The front end portion 31 is formed with a reduced-diameter ring fitting portion 34 fitted in the connecting ring 85. By fitting the ring fitting portion 34 in the connecting ring 85, the ceramic heater 2 and the center wire 3 are integrally connected via the connecting ring 85 along the axis AX. The front end portion 31 and the connecting ring 85 are integrally joined by laser beam welding. Thus, the center wire 3 has electrical continuity with the electrode drawing-out portion 26 of the ceramic heater 2 via the connecting ring 85.

As shown in FIG. 2, of the rear end portion 32 of the center wire 3, a connecting end portion 36 which is on the most rear end side GK is knurled on an outer surface 39 thereof and protrudes from the rear end surface 48 of the main metal shell 4.

Next, the terminal member 5 will be described. The terminal member 5 is a metal member and may be divided into a hole-inside portion 55 positioned on the front end side GS thereof and disposed within the shaft hole 43 of the main metal shell 4, and a hole-outside portion 56 protruding from the rear end surface 48 of the main metal shell 4 toward the rear end side GK in the axial direction HJ (see FIG. 4). The terminal member 5 includes a tubular enclosing portion 51 having a bottom and opened toward the front end side GS along the axial direction HJ, the enclosing portion 51 housing the rear end portion 32 of the center wire 3 and airtightly covering the rear end portion 32 radially circumferentially and from the rear end side GK. The enclosing portion 51 is fixed onto the connecting end portion 36 of the rear end portion 32 of the center wire 3 by crimping, thus retaining the rear end portion 32 of the center wire 3. Accordingly, the rear end portion 32 of the center wire 3 and the enclosing portion 51 of the terminal member 5 are joined via the outer surface 39 of the connecting end portion 36 and an inner connecting surface 58 of an inner surface 57 of the enclosing portion 51, and have electrical continuity. According to the present embodiment, of the enclosing portion 51, a hole-inside enclosing portion 52 on the front end side GS corresponds to the hole-inside portion 55, and is positioned within the shaft hole 43 of the main metal shell 4. On the other hand, of the enclosing portion 51, a terminal portion 54 which is further toward the rear end side GK than the hole-inside enclosing portion 52 and which will be described below, corresponds to the hole-outside portion 56. On the outer periphery of the terminal member 5, specifically the outer periphery of the hole-outside portion 56, a step portion 53 is formed. The terminal portion 54 is on the rear end side GK of the enclosing portion 51. The terminal portion 54 is used as an energization terminal fitted with a plug cap (not shown) when the glow plug 1 is installed on the engine head.

In the shaft hole 43 of the main metal shell 4, the O-ring 7 and the insulating spacer 6 are disposed in order from the front end side GS in a cylindrical space between an inner peripheral surface 43*m* of the main metal shell 4 forming the shaft hole 43 and the hole-inside enclosing portion 52 of the terminal member 5. Of these, the insulating spacer 6 is made of a tubular insulator (specifically, a fluorine-based rubber), and positioned on the rear end side GK in the axial direction HJ with respect to the O-ring 7. The insulating spacer 6 is disposed between the inner peripheral surface 43*m* of the main metal shell 4 and the terminal member 5 so that the main metal shell 4 can be reliably spaced apart from the center wire 3 and the terminal member 5, thereby preventing them from contacting and causing a short circuit. The O-ring 7 and the insulating spacer 6 are disposed in the shaft hole 43 together with the hole-inside enclosing portion 52, with the O-ring 7 and the insulating spacer 6 externally fitted onto the hole-inside enclosing portion 52, i.e., the hole-inside portion 55, of the enclosing portion 51 of the terminal member 5 (see FIG. 4). The insulating spacer 6 has a greater diameter on the rear end side GK than on the front end side GS so that the insulating spacer 6 can be abutted on the tapered portion 47 of the main metal shell 4 to have a limited depth of insertion in the axial direction HJ. The terminal member 5 engages the insulating spacer 6 at the step portion 53 and biases the insulating spacer 6 toward the front end side GS in the axial direction HJ.

Figure 3:
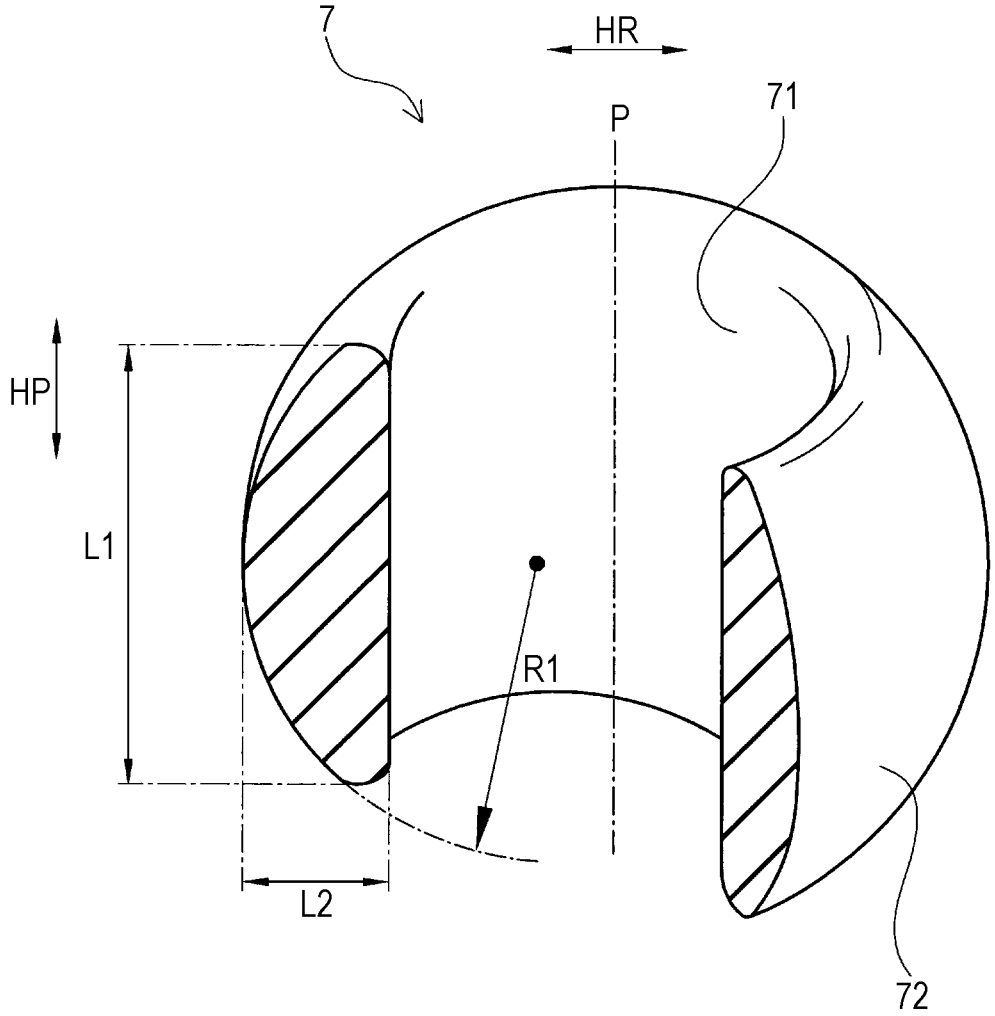
FIG. 3 is a perspective view including a partial cross sectional view of an O-ring used in the glow plug according to the embodiment.

The O-ring 7 is made of an insulating rubber-like elastic material (specifically, a fluorine-based rubber). The O-ring 7 airtightly seals between the inner peripheral surface 43*m* of the main metal shell 4 and the terminal member 5 while insulating them from each other in the shaft hole 43 of the main metal shell 4, thus sealing the shaft hole 43. The O-ring 7, as shown in FIG. 3, has an outwardly bulging, substantially D-shaped cross sectional shape in a free state. Specifically, the O-ring 7 is a ring encircling a member axis P as its own axis and bulging outward in a radial direction HR (left-right direction in FIG. 3) orthogonal to the member axis P. The O-ring 7 includes a member outer peripheral surface 72 extending in a member axial direction HP (in a top-bottom direction in FIG. 3; i.e., in a cross section including the member axis P) which is along the member axis P with a radius of curvature R1, and a member inner peripheral surface 71 which is cylindrical. A dimension L1 in the member axial direction HP is greater than a thickness dimension L2 in the member axial direction HP. In addition, the inner diameter of the O-ring 7 in a free state is smaller than the outer diameter of the hole-inside enclosing portion 52 of the terminal member 5. Thus, the O-ring 7 is externally fitted onto the hole-inside enclosing portion 52 of the terminal member 5 in a tightened manner and disposed in the shaft hole 43.

Because the O-ring 7 has the substantially D-shaped cross sectional shape in a free state, when the O-ring 7 is press-fitted between the inner peripheral surface 43*m* of the main metal shell 4 and the hole-inside enclosing portion 52 of the terminal member 5, the member inner peripheral surface 71 of the O-ring 7 becomes closely attached to the hole-inside enclosing portion 52 of the terminal member 5 via the cylindrical surface with a large dimension in the axial direction HJ. On the other hand, the member outer peripheral surface 72 contacts the inner peripheral surface 43*m* of the main metal shell 4 with a cylindrical surface with a relatively short dimension in the axial direction HR which is formed as the outward bulge in the radial direction HR is compressed, thus enabling the member outer peripheral surface 72 to slide on the inner peripheral surface 43*m* during press-fitting. Thus, the O-ring 7 can be inserted into the shaft hole 43 by press-fitting to seal the shaft hole 43 while the development of rotation or localized torsion in the O-ring 7 is suppressed. The O-ring 7 can be smoothly guided into the shaft hole 43 by the tapered portion 47 of the main metal shell 4 during the insertion.

Figure 5:
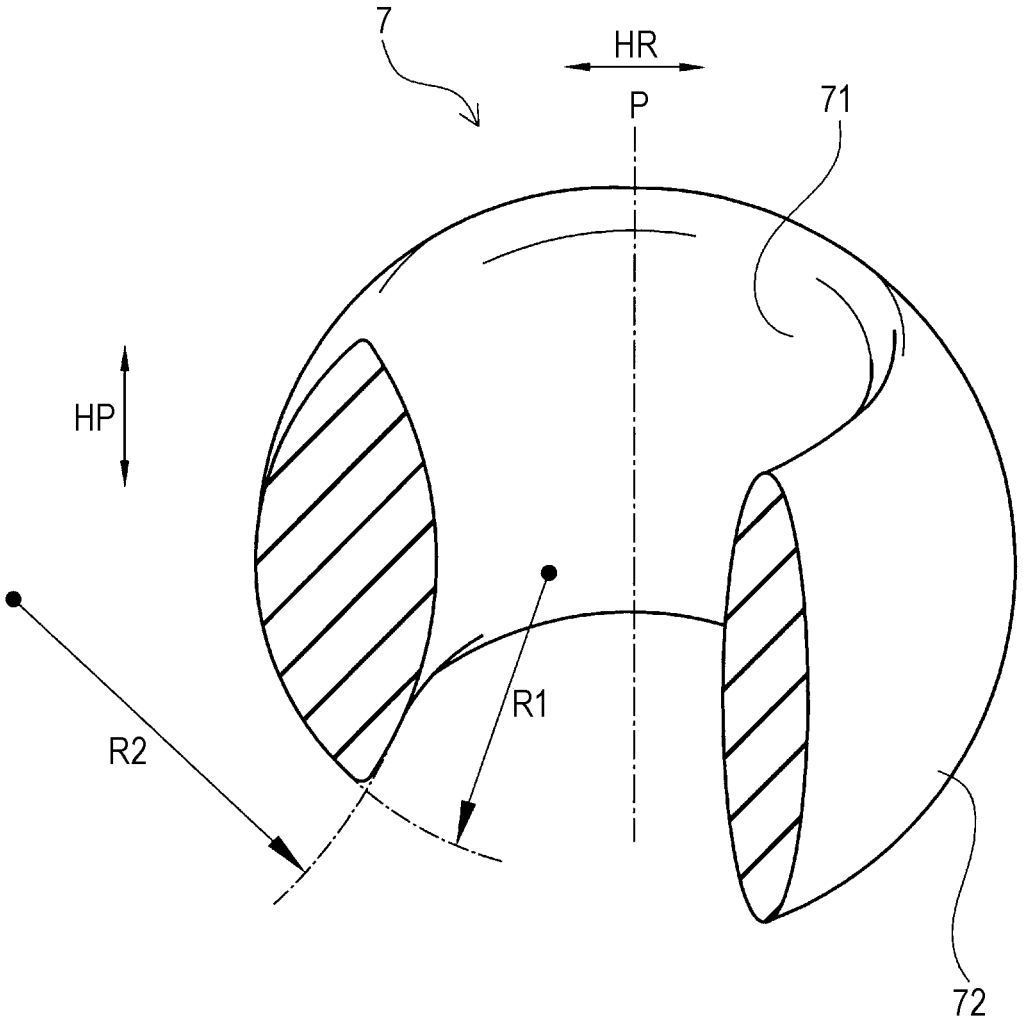
FIG. 5 is a perspective view including a partial cross sectional view of the O-ring according to a modification.

According to the present embodiment, the O-ring 7 has the cylindrical member inner peripheral surface 71 with the same cross sectional shape with respect to the member axial direction HP (i.e., with the same inner diameter). However, as shown in FIG. 5, for example, the O-ring 7 may have the member inner peripheral surface 71 that bulges inward in the radial direction HR with a radius of curvature R2 in the member axial direction HP (i.e., in a cross section including the member axis P) greater than the radius of curvature R1 of the member outer peripheral surface 72. In this case, preferably, the radius of curvature R2 may be increased as much as possible.

In the glow plug 1 according to the present embodiment, the ceramic heater 2 corresponds to a "heater" according to the present invention, and the center wire 3 corresponds to a "conductive member" according to the present invention. The O-ring 7 corresponds to a "sealing member" according to the present invention. Of the main metal shell 4, the rear end surface 48 corresponds to a "rear end" according to the present invention. Of the terminal member 5, the hole-inside portion 55 (or the corresponding hole-inside enclosing portion 52) corresponds to "one part" of the terminal member 5 according to the present invention, and the hole-outside portion 56 corresponds to "another part" of the terminal member 5 according to the present invention. The step portion 53 of the terminal member 5 corresponds to a "spacer engaging portion" according to the present invention.

As described above, in the glow plug 1 according to the present invention, the rear end portion 32 of the center wire 3 (conductive member) is housed in the enclosing portion 51 of the terminal member 5, and the shaft hole 43 is sealed by airtightly sealing between the inner peripheral surface 43*m* of the main metal shell 4 and the enclosing portion 51 of the terminal member 5 with the O-ring 7 (sealing member) in the shaft hole 43 of the main metal shell 4. Thus, the rear end portion 32 of the center wire 3, including the outer surface 39 of the connecting end portion 36, and the inner surface 57 of the enclosing portion 51 of the terminal member 5, including the inner connecting surface 58 of the enclosing portion 51, do not come into contact with the external air at the rear end side GK of the glow plug 1, such as moisture or corrosive gas. In this way, in the glow plug, corrosion of the outer surface 39 of the connecting end portion 36 of the center wire 3 and the inner connecting surface 58 of the enclosing portion 51 of the terminal member 5 is suppressed.

In the glow plug 1 according to the present embodiment, the insulating spacer 6 is disposed on the rear end side GK of the O-ring 7 between the inner peripheral surface 43*m* of the main metal shell 4 and the terminal member 5. Thus, the center wire 3 and the terminal member 5 can be reliably spaced apart from the main metal shell 4 when they are retained, so that reliable insulation can be obtained between the main metal shell 4 and the terminal member 5. Further, the external air (such as moisture or corrosive gas) can be suppressed from reaching the O-ring 7.

In the glow plug 1 according to the present embodiment, the step portion 53 (spacer engaging portion) of the terminal member 5 is engaged with the insulating spacer 6 so that the insulating spacer 6 is biased toward the front end side GS in the axial direction HJ. Thus, falling or loosening of the O-ring 7 can be prevented via the insulating spacer 6.

In the glow plug 1 according to the present embodiment, the O-ring 7 has the outwardly bulging, substantially D-shaped cross sectional shape in a free state. Thus, when the O-ring 7 is press-fitted between the inner peripheral surface 43*m* of the main metal shell 4 and the terminal member 5, the member inner peripheral surface 71 of the O-ring 7 becomes closely attached to the terminal member 5 via a cylindrical surface having a large dimension in the axial direction HJ. On the other hand, the member outer peripheral surface 72 contacts the inner peripheral surface 43*m* of the main metal shell 4 via a cylindrical surface having a relatively small dimension in the axial direction HJ, with the outward bulge in the radial direction HR compressed. Thus, the O-ring 7 can be inserted into the shaft hole 43 while the development of rotation or localized torsion in the O-ring 7 upon press-fitting is suppressed. Accordingly, searing stress due to torsional strain does not easily remain in the O-ring 7, so that the reliability of sealing by the O-ring 7 can be increased by suppressing troubles, such as the tearing of the O-ring 7.

Next, a method for manufacturing the glow plug 1 will be described. First, a method for manufacturing the ceramic heater 2 will be described. An unbaked heating resistor is formed by integral injection molding of conductive ceramic powder and the like. Meanwhile, unbaked split molds with cavities for housing the unbaked heating resistor in the mating faces are formed in advance by press forming of insulating ceramic powder and the like by using a metallic mold.

With the unbaked heating resistor placed in the cavities between the unbaked split molds, compression pressing is performed. Thereafter, sintering processes, such as debinding and hot-pressing, are performed and, after the outer peripheral surface is polished and finished, the round-bar-like ceramic heater 2 with the hemispherical front end portion 22 is obtained.

Then, the connecting ring 85 and the shell 8 are formed from stainless steel material into predetermined shapes, and the surface of the connecting ring 85 is treated with Au plating. The rear end portion 23 of the ceramic heater 2 is press-fitted in the connecting ring 85, and continuity is established between the connecting ring 85 and the electrode drawing-out portion 26 of the ceramic heater 2. The ceramic heater 2 is then press-fitted in the tubular hole 84 of the shell 8, and continuity is established between the shell 8 and the electrode drawing-out portion 25. Thus, the ceramic heater 2, the connecting ring 85, and the shell 8 are integrated.

The center wire 3 is formed by subjecting a bar-like member of an iron-based material (such as Fe—Cr—Mo steel) cut to a predetermined dimension to plastic forming, cutting, and the like. The ring fitting portion 34 of the center wire 3 is press-fitted in the connecting ring 85, and their engaged portions are laser beam welded. Thus, the center wire 3 and the ceramic heater 2 are integrally coupled via the connecting ring 85.

Further, the tubular main metal shell 4 is formed from an iron-based material, such as S45C. On the installation portion 42, threads are formed by rolling. The opening portion of the shaft hole 43 in the rear end portion 45 of the main metal shell 4 is formed into the tapered portion 47 expanding toward the rear end surface 48 by cutting and the like. The center wire 3 integrated with the ceramic heater 2 and the like is inserted into the shaft hole 43 of the main metal shell 4 from the front end side GS, and the front end portion 41 of the main metal shell 4 and the main metal shell fitting portion 83 of the shell 8 are fitted with each other. The engaged portions of the main metal shell 4 and the shell 8 are integrally joined by laser beam welding.

Figure 4:
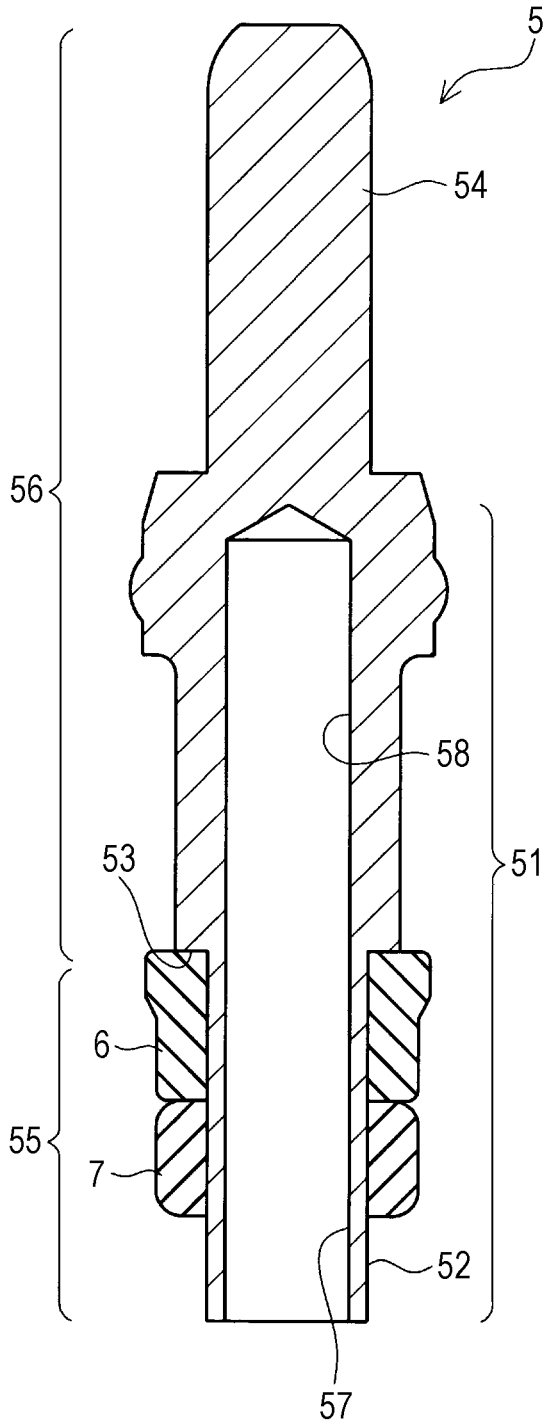
FIG. 4 is a longitudinal cross-sectional view of a terminal member of the glow plug according to the embodiment with the O-ring and an insulating spacer externally fitted onto the terminal member.

Next, as shown in FIG. 4, the insulating spacer 6 is externally fitted onto the hole-inside enclosing portion 52 of the terminal member 5 and, further, the O-ring 7 is externally fitted on the front end side GS of the insulating spacer in a tightened manner (externally fitting step). At this point, the insulating spacer 6 is engaged with the step portion 53 (spacer engaging portion) of the terminal member 5.

Next, the hole-inside enclosing portion 52 of the terminal member 5, together with the O-ring 7 and the insulating spacer 6, is inserted into the shaft hole 43 from the rear end surface 48 of the main metal shell 4, with the O-ring 7 being pressed toward the front end side GS in the axial direction HJ by the insulating spacer 6 engaged with the step portion 53 of the terminal member 5, and with the member inner peripheral surface 72 of the O-ring 7 being pressed onto the inner peripheral surface 43*m* of the main metal shell 4 (inserting step). The insulating spacer 6 is positioned with respect to the axial direction HJ when abutted on the tapered portion 47 of the main metal shell 4. Thus, the shaft hole 43 is sealed by the O-ring 7, and the rear end portion 32 of the center wire 3 is housed in the enclosing portion 51 of the terminal member 5. Thereafter, the enclosing portion 51 of the terminal member 5 is fixed onto the connecting end portion 36 of the center wire 3 in the enclosing portion 51 by crimping. In this way, the outer surface 39 of the connecting end portion 36 of the center wire 3 is joined to the inner connecting surface 58 of the inner surface 57 of the enclosing portion 51 of the terminal member 5, whereby the glow plug 1 is completed.

According to the present embodiment, the hole-inside portion 55 (hole-inside enclosing portion 52) of the terminal member 5 also corresponds to a "portion forming one part" of the terminal member 5 according to the present invention.

As described above, in the method for manufacturing the glow plug 1 according to the present embodiment, the O-ring 7 is externally fitted onto the terminal member 5 in the externally fitting step, and then the terminal member 5 with the externally fitted the O-ring 7 is inserted into the shaft hole 43 of the main metal shell 4 from the rear end side GK in the axial direction HJ in the subsequent inserting step. Thus, the O-ring 7 can be easily disposed between the inner peripheral surface 43*m* of the main metal shell 4 and the terminal member 5. Further, in this way, the outer surface 39 of the connecting end portion 36 of the center wire 3 and the inner connecting surface 58 of the enclosing portion 51 of the terminal member 5 can be prevented from coming into contact with moisture or corrosive gas contained in the external air. Accordingly, the glow plug 1 such that corrosion of these portions is suppressed can be obtained.

Further, in the method for manufacturing the glow plug 1 according to the present embodiment, the insulating spacer 6 is externally fitted onto the rear end side GK of the O-ring 7 in the axial direction HJ in the externally fitting step, and the terminal member 5, the O-ring 7, and the insulating spacer 6 are inserted into the shaft hole 43 of the main metal shell 4 from the rear end side GK in the axial direction HJ in the inserting step. Thus, the O-ring 7 and the insulating spacer 6 can be easily disposed.

In the method for manufacturing the glow plug 1 according to the present embodiment, the O-ring 7 is a rubber-like elastic material and has an outwardly bulging, substantially D-shaped cross sectional shape in a free state. In the externally fitting step, the O-ring 7 is externally fitted onto the terminal member 5 in a tightened manner. Namely, the O-ring 7 is externally fitted onto the hole-inside enclosing portion 52 of the terminal member 5 that has a greater outer diameter than the inner diameter of the O-ring 7 in a free state. In the inserting step, the portion forming one part of the terminal member 5 is inserted into the shaft hole 43 from the rear end surface while the member outer peripheral surface 72 of the O-ring 7 is pressed onto the inner peripheral surface 43*m* of the main metal shell 4. Thus, the O-ring 7 can be disposed between the inner peripheral surface 43*m* of the main metal shell 4 and the terminal member 5 while suppressing the development of rotation or localized torsion in the O-ring 7 in the inserting step.

While the present invention has been described with reference to embodiments, the present invention is not limited to the foregoing embodiments, and it goes without saying that various modifications may be made as needed without departing from the gist of the invention.

For example, while the glow plug 1 according to the foregoing embodiments is a so-called ceramic glow plug provided with the ceramic heater 2, the glow plug 1 is not limited to such example and may be a so-called metal glow plug provided with a heater in which a heating coil or a heating coil and a control coil are housed in a metal sheath.

While the front end portion 41 of the main metal shell 4 according to the foregoing embodiments retains the ceramic heater 2 via the shell 8, the heater may be directly retained by the front end portion of the main metal shell 4.

According to the foregoing embodiments, one part (connecting end portion 36) of the center wire 3 protrudes from the rear end surface 48 (rear end) of the main metal shell 4, and the terminal member 5 has the hole-inside portion 55 (hole-inside enclosing portion 52) as the one part of the enclosing portion 51 positioned in the shaft hole 43 of the main metal shell 4. However, the center wire 3 may be entirely positioned in the shaft hole 43 of the main metal shell 4. In this case, the enclosing portion 51 of the terminal member 5 is also entirely or mostly positioned in the shaft hole 43 of the main metal shell 4.

DESCRIPTION OF REFERENCE NUMERALS

AX Axis
HJ Axial direction
GS Front end side
GK Rear end side
1 Glow plug
2 Ceramic heater (heater)
25, 26 Electrode drawing-out portion
3 Center wire (conductive member)
32 Rear end portion (of center wire)
4 Metal shell
43 Shaft hole
43*m* Inner peripheral surface (of main metal shell)
48 Rear end surface (rear end)
5 Terminal member
51 Enclosing portion
52 Hole-inside enclosing portion
53 Step portion (spacer engaging portion)
55 Hole-inside portion
56 Hole-outside portion
6 Insulating spacer
7 O-ring (sealing member)
71 Member inner peripheral surface
72 Member outer peripheral surface
P Member axis
HP Member axis direction
HR Radial direction
R1, R2 Radius of curvature

The invention claimed is:

1. A glow plug comprising:

a heater that generates heat by energization;

a main metal shell having a tubular shape with a shaft hole and retaining the heater directly or indirectly on a front end side in an axial direction extending along its own axis;

a metal conductive member having electrical continuity with one terminal of the heater and extending in the shaft hole toward a rear end side in the axial direction, the metal conductive member having a portion protruding from a rear end of the main metal shell toward the rear end side in the axial direction;

a metal terminal member with one part positioned in the shaft hole and another part protruding from the rear end of the main metal shell toward the rear end side in the axial direction, the terminal member including an enclosing portion opened toward the front end side in the axial direction, the enclosing portion housing a rear end portion of the conductive member and having electrical continuity with the rear end portion, the terminal member being disposed in the shaft hole while spaced apart from an inner peripheral surface of the main metal shell forming the shaft hole, the metal terminal member being in contact with at least a part of the portion of the metal conductive member protruding from the rear end of the main metal shell;

a sealing member made of an insulator and airtightly sealing and insulating between the inner peripheral surface and the terminal member in the shaft hole; and an insulating spacer made of an insulator and positioned on the rear end side of the sealing member in the axial direction between the inner peripheral surface and the terminal member, wherein the one part positioned in the shaft hole is provided between the metal conductive member and the sealing member.

2. The glow plug as claimed in claim 1, wherein the terminal member includes a spacer engaging portion and is engaged with the insulating spacer at the spacer engaging portion, and the insulating spacer is biased toward the front end side in the axial direction.

3. The glow plug as claimed in claim 1, wherein the sealing member is made of an insulating rubber-like elastic material, the sealing member, in a free state, has a ring shape encircling its own member axis, the sealing member includes a member outer peripheral surface having a shape bulging outward in a radial direction of the member axis with a radius of curvature R1 in a member axial direction along the member axis, and a member inner peripheral surface having a shape bulging inward in the radial direction with a radius of curvature R2 in the member axial direction which is greater than the radius of curvature R1, or having a tubular shape with the same cross sectional shape with respect to the member axial direction;

the sealing member has a dimension in the member axial direction which is greater than a thickness dimension in the radial direction, and the sealing member is pressed onto the inner peripheral surface of the main metal shell via the member outer peripheral surface and onto the terminal member via the member inner peripheral surface.

4. A method for manufacturing a glow plug, the glow plug including:

a heater that generates heat by energization;

a main metal shell having a tubular shape with a shaft hole and retaining the heater directly or indirectly on a front end side in an axial direction extending along its own axis;

a metal conductive member having electrical continuity with one terminal of the heater and extending in the shaft hole toward a rear end side in the axial direction, the metal conductive member having a portion protruding from a rear end of the main metal shell toward the rear end side in the axial direction;

a metal terminal member with one part positioned in the shaft hole and another part protruding from the rear end of the main metal shell toward the rear end side in the axial direction, the terminal member including an enclosing portion opened toward the front end side in the axial direction, the enclosing portion housing a rear end portion of the conductive member and having electrical continuity with the rear end portion, the terminal member being disposed in the shaft hole while spaced apart from an inner peripheral surface of the main metal shell forming the shaft hole, the metal terminal member being in contact with at least a part of the portion of the metal conductive member protruding from the rear end of the main metal shell; and a sealing member made of an insulator and airtightly sealing and insulating between the inner peripheral surface and the terminal member in the shaft hole; and an insulating spacer made of an insulator and positioned on the rear end side of the sealing member in the axial direction between the inner peripheral surface and the terminal member, wherein the one part positioned in the shaft hole is provided between the metal conductive member and the sealing member, the method comprising:

an externally fitting step of externally fitting the sealing member onto a portion forming the one part of the terminal member; and an inserting step of inserting the portion forming the one part of the terminal member, the portion having the sealing member externally fitted onto the portion into the shaft hole from the rear end side of the main metal shell in the axial direction.

5. The method for manufacturing a glow plug as claimed in claim 4, wherein the externally fitting step includes externally fitting the insulating spacer onto the portion forming the one part of the terminal member such that the insulating spacer is positioned on the rear end side of the sealing member in the axial direction, and the inserting step includes inserting the portion forming the one part of the terminal member, the portion having the sealing member and the insulating spacer externally fitted onto the portion into the shaft hole from the rear end side of the main metal shell in the axial direction.

6. The method for manufacturing a glow plug as claimed in claim 4, wherein the sealing member is made of an insulating rubber-like elastic material, the sealing member, in a free state, has a ring shape encircling its own member axis, the sealing member includes a member outer peripheral surface having a shape bulging outward in a radial direction of the member axis with a radius of curvature R1 in a member axial direction along the member axis, and a member inner peripheral surface having a shape bulging inward in the radial direction with a radius of curvature R2 in the member axial direction which is greater than the radius of curvature R1, or having a tubular shape with the same cross sectional shape with respect to the member axial direction, the sealing member has a dimension in the member axial direction which is greater than a thickness dimension in the radial direction, and the sealing member is pressed onto the inner peripheral surface of the main metal shell via the member outer peripheral surface and onto the terminal member via the member inner peripheral surface, the external fitting step includes externally fitting the sealing member onto the portion forming the one part in a tightened manner, and the inserting step includes inserting the portion forming the one part of the terminal member into the shaft hole from the rear end of the main metal shell while causing the member outer peripheral surface of the sealing member to be pressed onto the inner peripheral surface of the main metal shell.

7. The glow plug as claimed in claim 1, wherein the one part of the metal conductive member is positioned rearward of the sealing member in the axial direction.

8. The method for manufacturing a glow plug as claimed in claim 4, wherein the one part of the metal conductive member is positioned rearward of the sealing member in the axial direction.

* * * * *